US005233326A

United States Patent [19]

Motoyoshi

[11] Patent Number: 5,233,326

[45] Date of Patent: Aug. 3, 1993

[54] POSITIVE TEMPERATURE COEFFICIENT THERMISTOR DEVICE

[75] Inventor: Yoshimitsu Motoyoshi, Iwamizawa, Japan

[73] Assignee: Nippon Oil & Fats Co., Ltd., Tokyo, Japan

[21] Appl. No.: 875,288

[22] Filed: Apr. 28, 1992

[30] Foreign Application Priority Data

Nov. 8, 1991 [JP] Japan ..... 3-099663[U]

[51] Int. Cl.[5] ..... H01C 7/10

[52] U.S. Cl. ..... 338/22 R; 338/220; 338/221; 338/232; 338/276; 338/325

[58] Field of Search ..... 338/22 R, 225 D, 220, 338/221, 232-233, 325, 276, 333

[56] References Cited

U.S. PATENT DOCUMENTS

| | | | |
|---|---|---|---|
| 3,750,082 | 7/1973 | Petersen et al. | 338/220 |
| 3,914,727 | 10/1975 | Fabricius | 338/22 R X |
| 4,635,026 | 1/1987 | Takeuchi | 338/22 R X |
| 4,939,498 | 7/1990 | Yamada et al. | 338/22 R |
| 5,142,265 | 8/1992 | Motoyoshi et al. | 338/22 R |

FOREIGN PATENT DOCUMENTS

| | | |
|---|---|---|
| 59-15171 | 5/1984 | Japan . |
| 1-220403 | 9/1989 | Japan . |

*Primary Examiner*—Marvin M. Lateef

*Attorney, Agent, or Firm*—Oblon, Spivak, McClelland, Maier & Neustadt

[57] ABSTRACT

A positive temperature coefficient thermistor device comprises a pair of positive temperature coefficient thermistor elements, a common terminal plate having a heat conducting terminal member and a common terminal member and being sandwiched between the positive temperature coefficient thermistor elements, and a pair of terminal plates having spring terminal members for clamping the positive temperature coefficient thermistor elements. The common terminal member of the common terminal plate is formed to have a width between the heat conducting terminal member and an insertion hole in the mounting plate on which the positive temperature coefficient thermistor device is to be mounted that is no larger than necessary for its insertion in the insertion hole. A catch is provided on the heat conducting terminal member for engaging with a wall of the insulating case for preventing extraction of the common terminal plate from the insulating case.

3 Claims, 3 Drawing Sheets

POSITIVE TEMPERATURE COEFFICIENT THERMISTOR DEVICE

BACKGROUND OF THE INVENTION

1. Field of the Invention

This invention relates to a positive temperature coefficient thermistor device, more particularly to an encased positive temperature coefficient thermistor device for use in the demagnetization circuit of a color television set, a color video display or the like.

2. Prior Art Statement

A typical positive temperature coefficient thermistor device for use in the demagnetization circuit of a color television set or the like is taught by Japanese Utility Model Publication Sho 59-15171.

As shown in FIG. 5, this conventional positive temperature coefficient thermistor device, denoted by reference numeral 1, has a positive temperature coefficient thermistor element 3 for demagnetization and a positive temperature coefficient thermistor element 4 for heating, which are enclosed in an insulating case 2 and opposed to each other through a heat conducting terminal member 6 of a common terminal plate 5. The positive temperature coefficient thermistor element 3 and the positive temperature coefficient thermistor element 4 are clamped between the spring terminal members 8 of a pair of terminal plates 7. The common terminal member 9 of the common terminal plate 5 and the terminal members 10 of the terminal plates 7 extend to the exterior of the insulating case 2. The common terminal plate 5 is formed of a metal material exhibiting a thermal conductivity of 0.02–0.09 cal/cm sec °C. and a thickness of 0.05–0.3 mm.

The positive temperature coefficient thermistor device 1 is used as shown in FIG. 6, for example. Specifically, the common terminal member 9 of the common terminal plate 5 and the terminal member 10 of the terminal plate 7 associated with the positive temperature coefficient thermistor element 4 for heating are connected with opposite ends of a series circuit constituted of a demagnetization power source 11 (providing an ac 120 V output, for example) and a switch 12, and a coil 13 is connected across the terminal members 10 of the terminal plates 7,7 associated with the positive temperature coefficient thermistor elements 3 and 4. When the switch 12 is closed, the voltage of the demagnetization power source 11 is applied across the positive temperature coefficient thermistor element 4 for heating, causing it to produce heat. This heat warms the positive temperature coefficient thermistor element 3 for demagnetization, causing its resistance to increase. The demagnetization current flowing through the demagnetization coil 13 thus decreases, whereby it becomes possible to cancel the magnetism around a color TV picture tube, for example.

The common terminal member 9 of the common terminal plate 5 in the positive temperature coefficient thermistor device 1 is exposed to high temperatures. The temperature reached, while varying with the thickness of the common terminal plate 5, is as high as 87°–101° C. when the common terminal plate 5 is formed of stainless steel having a thermal conductivity of 0.03 cal/cm sec °C. and as high as 93°–108° C. when it is formed of nickel silver. Because of this, the mounting panel on which the positive temperature coefficient thermistor device 1 is mounted and electronic components located in vicinity of the positive temperature coefficient thermistor device 1 tend to suffer heat degradation over a short period of time.

Typical of the arrangements of the positive temperature coefficient thermistor device 1 that have been developed for preventing the common terminal member 9 of the common terminal plate 5 from being heated to a high temperature is that disclosed by Japanese Patent Public Disclosure Hei 1-220403 and shown in FIG. 7.

The disclosed arrangement involves the provision of a row of through-holes 14 near the base of the common terminal member 9 so as to form a plurality of heat conduction bottlenecks 15. The heat conduction bottlenecks 15 suppress passage of the heat absorbed by the heat conducting terminal member 6 and thus prevent the common terminal member 9 from rising to a high temperature.

However, since the heat conduction suppressing effect of the heat conduction bottlenecks 15 is low, the maximum temperature of the common terminal member 9 of the positive temperature coefficient thermistor device 1 arranged in this manner is reduced only to around 74° C. so that the heat dissipated from the common terminal member 9 still causes rapid degradation of solder joints, the mounting panel and near-by electronic components. Moreover, power consumption is increased.

Another problem is that the provision of the through-holes 14 beneath the heat conducting terminal member 6 of the common terminal plate 5 means that the heat conducting terminal member 6 includes a region that is at least as high as the diameter of the through-holes 14. This means that an empty space is formed between the bottom of the insulating case 2 and the positive temperature coefficient thermistor element 3 for demagnetization or the positive temperature coefficient thermistor element 4 for heating and that, therefore, the size of the positive temperature coefficient thermistor device 1 is increased by the amount of this space. This is undesirable in a field where high priority is placed on size reduction.

The reference numerals not mentioned in the foregoing explanation with reference to FIG. 7 indicate the same components as the corresponding numerals in FIG. 5.

There is thus a need for a positive temperature coefficient thermistor device of a structure which ensures that as little as possible of the heat absorbed by the heat conducting terminal member 6 will be conducted to the common terminal member 9 but which does not increase the size of the device.

This invention is intended to overcome the aforesaid problems and provides a positive temperature coefficient thermistor device which effectively suppresses the conduction of heat from the heat conducting terminal member to the common terminal member without increasing the size of the device.

SUMMARY OF THE INVENTION

For achieving this object, the present invention provides a positive temperature coefficient thermistor device comprising an insulating case enclosing an empty internal space, a pair of positive temperature coefficient thermistor elements disposed face to face in the insulating case, a common terminal plate having a heat conducting terminal member and a common terminal member that extends from the heat conducting terminal member and being disposed with its heat conducting terminal member sandwiched between the pair of positive temperature coefficient thermistor elements and with its common terminal member protruding to the exterior of the insulating case, and a pair of terminal plates each consisting of a spring terminal member and a terminal member that extends from the spring terminal member and being disposed with its spring terminal member pressing onto the outer surface of one of the positive temperature coefficient thermistor elements to clamp the pair of positive temperature coefficient thermistor elements sandwiching the heat conducting terminal member between itself and the spring terminal member of the other terminal plate and with its terminal member protruding to the exterior of the insulating case, the common terminal member of the common terminal plate having a width between the heat conducting terminal member and a terminal insertion hole in a mounting panel on which the positive temperature coefficient thermistor device is to be mounted that is no larger than required to enable it to be inserted in the terminal insertion hole and the common terminal plate being further provided with a catch projecting from the heat conducting terminal member for engaging with the insulating case to prevent extraction of the common terminal plate from the insulating case when mounted therein.

Although the heat generated by the positive temperature coefficient thermistor element for heating is not totally prevented from flowing from the heat conducting terminal member to the common terminal in the positive temperature coefficient thermistor device according to this invention, the fact that the width of the common terminal member is made as made no wider than required for insertion in the terminal insertion hole and is thus only one-third to one-fifth as wide as in the conventional device makes it possible to achieve a pronounced reduction in heat conduction. In addition, the presence of the engaging member decreases dissipation of heat to the common terminal member by the amount of heat dissipated to the engaging member and consequently lowers thermal deterioration of the mounting panel.

The above and other features of the present invention will become apparent from the following description made with reference to the drawings.

DESCRIPTION OF THE PREFERRED EMBODIMENT

Figure 1:
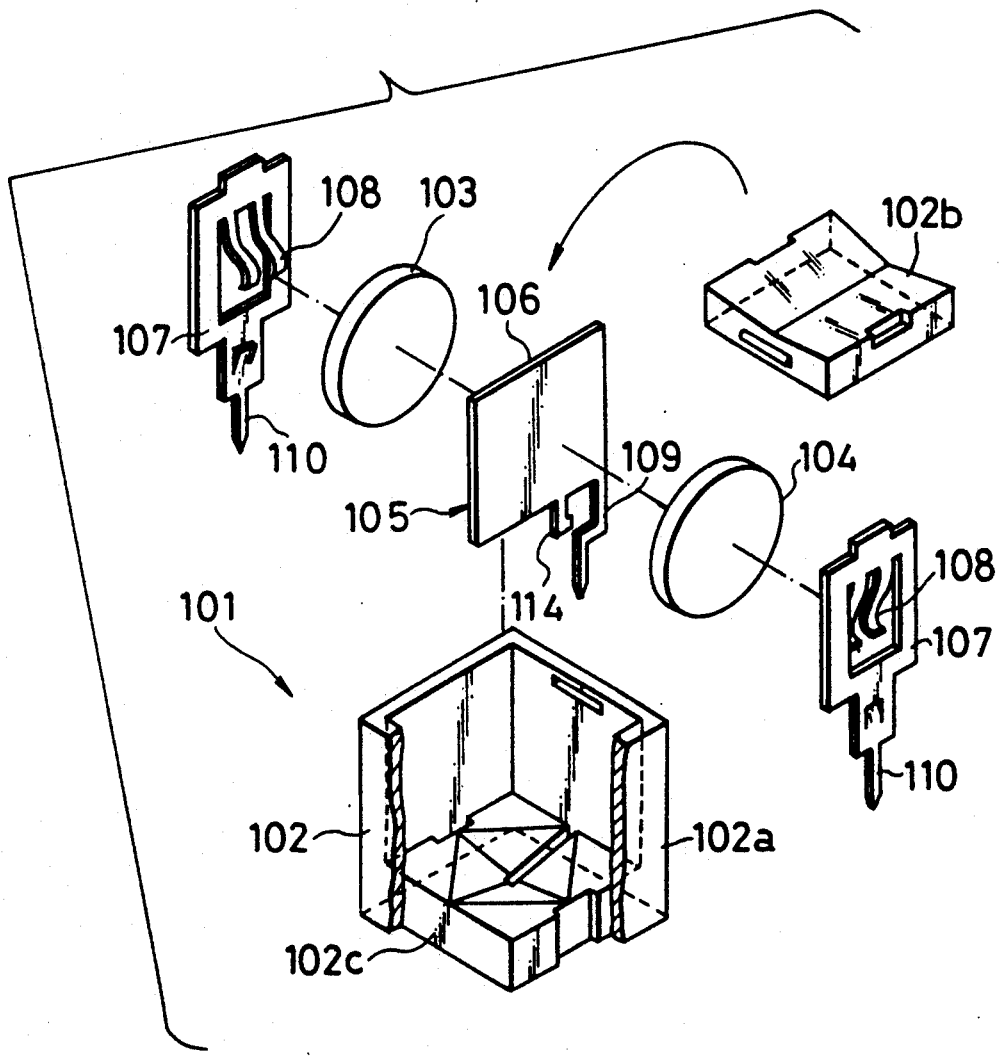
FIG. 1 is an exploded view, partially in section, showing how the positive temperature coefficient thermistor device according to the invention is assembled.
Figure 2:
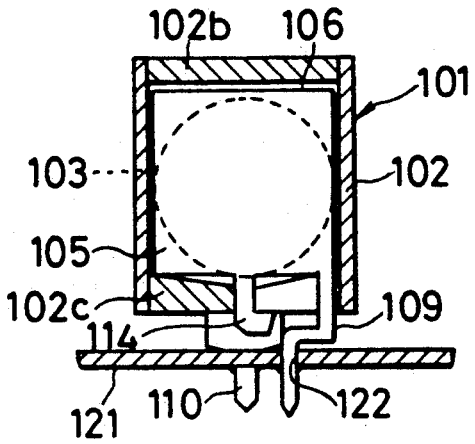
FIG. 2 is a sectional view of the positive temperature coefficient thermistor device of FIG. 1 showing an example of how it is mounted on a mounting panel.

The embodiment of the positive temperature coefficient thermistor device according to the invention designated by reference numeral 101 in FIG. 1 is constituted by an insulating case 102 having four side walls **102*a*, a top wall 102*b* and a bottom wall 102*c*, a positive temperature coefficient thermistor element 103 for demagnetization and a positive temperature coefficient thermistor element 104 for heating disposed in the insulating case 102 to face each other in the lateral direction, a common terminal plate 105 having a heat conducting terminal member 106 and a common terminal member 109 and disposed with its heat conducting terminal member 106 sandwiched between the positive temperature coefficient thermistor elements 103 and 104 and with its common terminal member 109 protruding to the exterior of the insulating case 102, and a pair of terminal plates 107, 107 each consisting of a spring terminal member 108 and a terminal member 110 that extends from the spring terminal member 108 and being disposed with its spring terminal member 108 pressing onto the outer surface of one of the positive temperature coefficient thermistor elements 103, 104 to clamp the pair of positive temperature coefficient thermistor elements 103, 104 sandwiching the heat conducting terminal member 106 between itself and the spring terminal member 108 of the other terminal plate 107** and with its terminal member protruding to the exterior of the insulating case.

Figure 3:
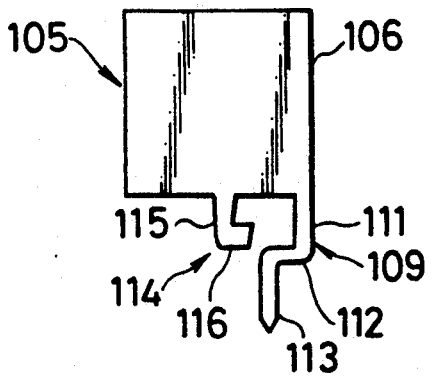
FIG. 3 is front view of one example of a common terminal plate used in the positive temperature coefficient thermistor device according to the invention.

As shown in FIG. 3, the common terminal member 109 of the common terminal plate 105 is a crank-shaped extension consisting of a first vertical section 111 extending downward from the lower edge of the heat conducting terminal member 106, a horizontal section 112 extending laterally from the lower end of the first vertical section 111 and a second vertical section 113 extending downward from the end of the horizontal section 112. The widths of the first vertical section 111, the horizontal section 112 and the second vertical section 113 are approximately the same and are no larger than required for enabling the common terminal member 109 to be inserted in an insertion hole 122 in a mounting panel 121 on which the positive temperature coefficient thermistor device 101 is to be mounted.

In addition, the common terminal plate 105 has a catch 114 extending downward from the center of the lower edge of its heat conducting terminal member 106.

Figure 4:
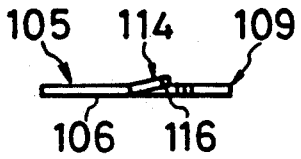
FIG. 4 is bottom view of the common terminal plate of FIG. 3.
Figure 5:
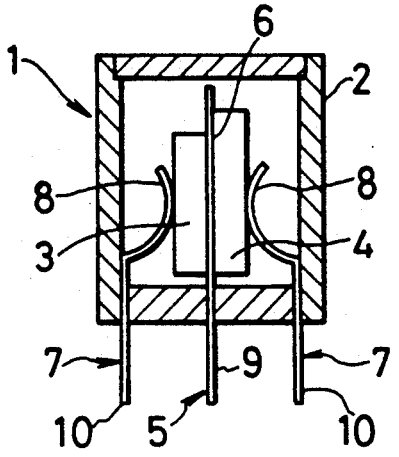
FIG. 5 PRIOR ART
FIG. 5 is sectional view of a conventional positive temperature coefficient thermistor device.
Figure 6:
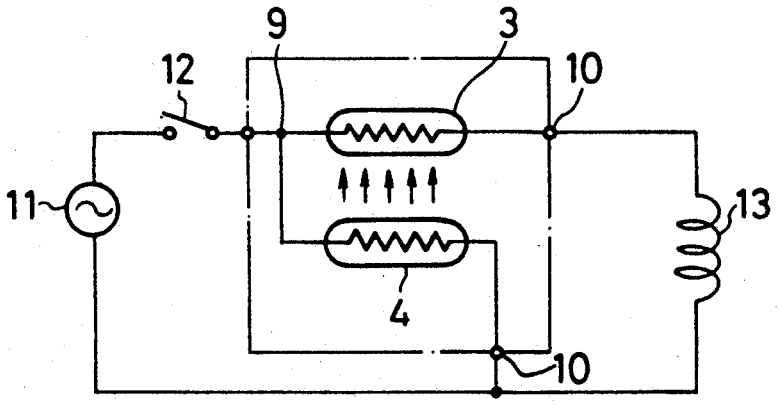
FIG. 6 PRIOR ART
FIG. 6 is diagram showing a demagnetization circuit employing a positive temperature coefficient thermistor device.
Figure 7:
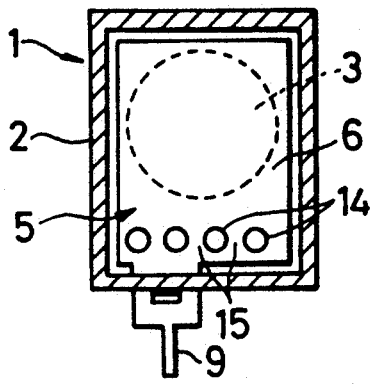
FIG. 7 PRIOR ART
FIG. 7 is a sectional view showing another conventional positive temperature coefficient thermistor device.

The catch 114, provided for preventing extraction of the common terminal plate 105 from the insulating case 102, is a hook-shaped extension consisting of a vertical section 115 which, like the first vertical section 111 of the common terminal member 109, extends downward and a horizontal section 116 which extends laterally from the lower end of the vertical section 115 toward the common terminal member 109. As shown in FIG. 4, after the common terminal plate 105 has been accommodated in the insulating case 102, the horizontal section 116 can be engaged with the undersurface of the bottom wall **102*c* of the insulating case 102** simply by twisting it by 5° to 20°.

Being of the foregoing construction, the positive temperature coefficient thermistor device 101 is assembled by first inserting into the insulating case 102 (with its top wall **102*b* removed as shown in FIG. 1) the common terminal plate 105 and the pair of terminal plates 107, 107 in such manner that the common terminal member 109, the catch 114** and the terminal members 110 pass through holes provided therefore in the bottom wall 102*c* and project to the exterior of the insulating case 102. The portion of the catch 114 protruding to the exterior is then twisted slightly with respect to the common terminal plate 105 so as to engage it with the undersurface of the bottom wall 102*c*. Next, the positive temperature coefficient thermistor element 103 for demagnetization is inserted between the common terminal plate 105 and one of the terminal plates 107 and the positive temperature coefficient thermistor element 104 for heating is inserted between the common terminal plate 105 and the other terminal plate 107, whereafter the upper opening of the insulating case 102 is closed with the top wall 102*b* to complete the assembly.

Since the spring terminal members 108 of the terminal plates 107 press onto the outer surfaces of the positive temperature coefficient thermistor elements 103, 104, the heat conducting terminal member 106 of the common terminal plate 105 is clamped tightly between them, while the positive temperature coefficient thermistor elements 103, 104 are stably retained by point or linear contact with the surfaces of recesses formed in the top wall 102*b* and the bottom wall 102*c*. Moreover, the fact that the common terminal member 109 and the catch 114 of the common terminal plate 105 and the terminal members 110, 110 of the terminal plates 107 project to the exterior of the insulating case 102 further contributes to the stability of the assembly. The engagement of the catch 114 with the outer surface of the bottom wall 102*c* of the insulating case 102 is particularly instrumental in maintaining the common terminal plate 105 stably in the prescribed position in the insulating case 102. Although the positive temperature coefficient thermistor device 101 is mounted on the mounting panel 121 by soldering the common terminal member 109 of the common terminal plate 105 to the mounting panel 121 after it has been inserted into the insertion hole 122, there is no danger of the mounting panel 121 or the solder joint therewith being exposed to high temperatures since the heat from the heat conducting terminal member 106 cannot easily reach these regions owing to the fact that the common terminal member 109 is narrow and that heat is dissipated to the exterior via the catch 114. Moreover, the increased length imparted to the common terminal member 109 by giving it a crank-shaped shape is also highly effective in promoting heat dissipation.

The diameter of the insertion hole 122 in the mounting panel 121 is generally 1.0 mm. As the common terminal plate, it is advisable to use a metal plate having a thickness of 0.3–1 mm so as ensure that it will have adequate mechanical strength.

The inventor fabricated a positive temperature coefficient thermistor device 101 according to the embodiment described above using a common terminal plate that was made of 0.4 mm thick stainless steel (SUS 304) and had a 1.0 mm wide common terminal member whose first vertical section was 7.3 mm long (4.0 mm of which projected to the exterior of the insulating case), whose horizontal section was 1.6 mm long and whose second vertical section was 5.5 mm long. He then operated the device by passing current through it. After 30 minutes of operation, the temperature of the tip of the common terminal member as measured by a thermocouple was found to be 64° C., which is a temperature that does not cause degradation of the mounting panel or have any appreciable adverse effect on near-by electronic components.

While a specific embodiment of the invention has been explained with respect to the drawings, the invention is in no way limited to this embodiment but can be modified variously within the scope of the appended claims.

As is clear from the foregoing description, in the positive temperature coefficient thermistor device according to this invention, the common terminal member of the common terminal plate sandwiched by the pair of positive temperature coefficient thermistor elements is made to have a width over the region extending between the heat conducting terminal member and a terminal insertion hole in a mounting panel on which the positive temperature coefficient thermistor device is to be mounted that is no larger than required for enabling the common terminal member to be inserted in the terminal insertion hole, and the common terminal plate is provided not only with the heat conducting terminal member and the common terminal member but also with a catch for engaging with the insulating case to prevent its extraction from the insulating case when mounted therein. Owing to this structure, the heat generated by the positive temperature coefficient thermistor element for heating that passes from the heat conducting terminal member of the common terminal plate to the common terminal member falls to a low temperature by the time it reaches the common terminal member, and, moreover, the catch dissipates heat to the exterior. As a result, the mounting plate does not suffer heat degradation and near-by electronic components are reliably protected from adverse heat effects. Stable, long-term utilization is therefore possible.

Moreover, the invention does not result in any increase in size and, therefore, the positive temperature coefficient thermistor device has wide applicability and high practical utility.

What is claimed is:

1. A positive temperature coefficient thermistor device comprising:

an insulating case enclosing an empty internal space, a pair of positive temperature coefficient thermistor elements disposed face to face in the insulating case, a common terminal plate having a heat conducting terminal member, a common terminal member in the form of a first elongated member that depends in a given direction from an edge portion of the heat conducting terminal member to the exterior of the insulating case, and a catch in the form of a second elongated member separated from said common terminal member that also depends in said given direction from said edge portion of the heat conducting terminal member and engages with a wall of the insulating case to prevent extraction of the common terminal plate from the insulating case and being disposed with its heat conducting terminal member sandwiched between the pair of positive temperature coefficient thermistor elements, the common terminal member of the common terminal plate being formed to have a width between the heat conducting terminal member and a terminal insertion hole in a mounting panel on which the positive temperature coefficient thermistor device is to bemounted that is no larger than necessary to enable it to be inserted in the terminal insertion hole, and a pair of terminal plates each consisting of a spring terminal member and a terminal member that extends from the spring terminal member and being disposed with its spring terminal member pressing onto the outer surface of one of the positive temperature coefficient thermistor elements to clamp the pair of positive temperature coefficient thermistor elements sandwiching the heat conducting terminal member between itself and the spring terminal member of the other terminal plate and with its terminal member protruding to the exterior of the insulating case.

2. A positive temperature coefficient thermistor device according to claim 1, wherein the common terminal member of the common terminal plate is crank-shaped and faces the catch.

3. The device according to claim 1, wherein said common terminal member and said catch are separated from each other in a direction perpendicular to said given direction.

* * * * *